US010272457B2

(12) United States Patent
McDonnell

(10) Patent No.: US 10,272,457 B2
(45) Date of Patent: Apr. 30, 2019

(54) DUAL SPRAYER, AND DUAL SPRAYER WITH DUAL CHAMBER BOTTLE

(71) Applicant: Joseph A. McDonnell, Miramar, FL (US)

(72) Inventor: Joseph A. McDonnell, Miramar, FL (US)

( * ) Notice: Subject to any disclaimer, the term of this patent is extended or adjusted under 35 U.S.C. 154(b) by 0 days.

(21) Appl. No.: 15/374,219

(22) Filed: Dec. 9, 2016

(65) Prior Publication Data

US 2017/0165689 A1 Jun. 15, 2017

Related U.S. Application Data

(60) Provisional application No. 62/285,002, filed on Dec. 9, 2015.

(51) Int. Cl.
*B05B 7/24* (2006.01)
*B05B 15/62* (2018.01)
*B05B 12/14* (2006.01)

(52) U.S. Cl.
CPC ..... *B05B 7/2408* (2013.01); *B05B 7/2443* (2013.01); *B05B 7/2472* (2013.01); *B05B 12/1409* (2013.01); *B05B 15/62* (2018.02)

(58) Field of Classification Search
CPC ... B05B 7/2408; B05B 15/061; B05B 12/002; B05B 7/2424; B05B 12/1409; B05B 7/2472; B05B 7/2443; B05B 15/62
USPC ..... 251/309–311; 239/310, 528, 526, 443
See application file for complete search history.

(56) References Cited

U.S. PATENT DOCUMENTS

| | | | |
|---|---|---|---|
| 2,719,704 | A | 10/1955 | Shanklin et al. |
| 3,291,395 | A | 12/1966 | Sharp |
| D222,255 | S | 10/1971 | Schmedes et al. |
| 3,964,689 | A | 6/1976 | Horvath, Jr. |
| D286,066 | S | 10/1986 | Goessling et al. |
| 5,100,059 | A | 3/1992 | Englhard et al. |
| 5,213,265 | A | 5/1993 | Englhard et al. |
| D339,407 | S | 9/1993 | Miseta |
| D339,408 | S | 9/1993 | Dutcher |
| D358,865 | S | 5/1995 | Englhard et al. |

(Continued)

FOREIGN PATENT DOCUMENTS

| | | | |
|---|---|---|---|
| DE | 202011051147 | U1 | 10/2011 |
| GB | 2004561 | A | 4/1979 |

OTHER PUBLICATIONS

"Off Bug Control," http://www.off.com/en-US/Products/Pages/OFF-Backyard.aspx (Accessed Dec. 10, 2015).

(Continued)

*Primary Examiner* — Darren W Gorman
*Assistant Examiner* — Qingzhang Zhou
(74) *Attorney, Agent, or Firm* — Harness, Dickey & Pierce, P.L.C.

(57) ABSTRACT

The sprayer includes a housing defining a chamber, and a cylinder within the chamber. The cylinder defines more than one discharge tube positioned in a longitudinal direction within the housing, the cylinder being selectively rotatable within the chamber. More than one suction tube extends from a lower portion of the housing. The more than one suction tube is in selective fluid communication with the more than one discharge tube of the cylinder, as the cylinder is rotated within the chamber.

15 Claims, 19 Drawing Sheets

(56) References Cited

U.S. PATENT DOCUMENTS

| | | | | |
|---|---|---|---|---|
| 5,544,810 | A | 8/1996 | Horvath, Jr. et al. | |
| 5,609,299 | A * | 3/1997 | Foster | B05B 11/3011 222/137 |
| 5,887,761 | A | 3/1999 | Foster et al. | |
| D441,832 | S | 5/2001 | DiMatteo | |
| 6,283,385 | B1 | 9/2001 | Beaver et al. | |
| 6,345,773 | B1 * | 2/2002 | Shanklin | B05B 7/2424 239/304 |
| 6,378,785 | B1 * | 4/2002 | Dodd | B05B 7/1209 239/318 |
| 6,425,534 | B2 | 7/2002 | Ketcham et al. | |
| 6,471,141 | B2 | 10/2002 | Smith et al. | |
| D474,265 | S | 5/2003 | Love et al. | |
| 6,604,546 | B1 | 8/2003 | Gilmore | |
| D480,124 | S | 9/2003 | Hubmann et al. | |
| 6,619,318 | B2 | 9/2003 | Dalhart et al. | |
| 6,772,966 | B2 * | 8/2004 | Foster | B05B 1/267 239/310 |
| D498,289 | S | 11/2004 | Chen | |
| D519,602 | S | 4/2006 | Dodd | |
| 7,063,277 | B2 | 6/2006 | Englhard et al. | |
| D532,862 | S | 11/2006 | Chung | |
| D533,918 | S | 12/2006 | Dodd | |
| 7,188,786 | B2 * | 3/2007 | Dodd | B05B 7/1209 222/630 |
| 7,237,728 | B1 | 7/2007 | Laible | |
| 7,328,857 | B2 | 2/2008 | Englhard et al. | |
| 7,407,117 | B2 | 8/2008 | Dodd | |
| 7,513,442 | B2 | 4/2009 | Dodd | |
| 7,631,819 | B2 | 12/2009 | Shanklin et al. | |
| 7,661,604 | B1 | 2/2010 | MacLean-Blevins | |
| D615,614 | S | 5/2010 | Tullney et al. | |
| 7,866,626 | B1 | 1/2011 | MacLean-Blevins | |
| D675,713 | S | 2/2013 | Christensen | |
| D709,988 | S | 7/2014 | Ford | |
| D742,999 | S | 11/2015 | Moya et al. | |
| 2004/0118944 | A1 | 6/2004 | Amaduzzi et al. | |
| 2004/0140372 | A1 | 7/2004 | Englhard et al. | |
| 2004/0140373 | A1 | 7/2004 | Joseph et al. | |
| 2006/0091237 | A1 * | 5/2006 | Dodd | B05B 7/1209 239/310 |
| 2006/0255180 | A1 | 11/2006 | Englhard et al. | |
| 2011/0240763 | A1 | 10/2011 | Svendsen et al. | |

OTHER PUBLICATIONS

"32oz Hose-End Sprayer Krud Kutter," https://www.fastenal.com/products/details/0611414 (Accessed Dec. 10, 2015).
"Hose End Sprayer," http://sell.pakuya.com/product-info/191085/hose-end-sprayer.html (Accessed Dec. 10, 2015).
"Liquid Hose End Sprayer," http://guiyo.en.alibaba.com/product/1793257365-221616123/Liquid_Hose_End_Sprayer.html (Accessed Dec. 10, 2015).
"Fertilizing Feeder Hose End," https://www.chapinmfg.com/products/product:g405-fertilizing-feeder-hose-end (Accessed Dec. 10, 2015).
"Wet and Dry Hose End Sprayer," http://www.hardwarestore.com/wet-and-dry-hose-end-sprayer-628748.aspx (Accessed Dec. 10, 2015).
"32 oz Super Concentrated Non-Refillable Roof and Exterior Surface Cleaner with Hose Sprayer," http://www.homedepot.com/p/Spray-Forget-32-oz-Super-Concentrated-Non-Refillable-Roof-and-Exterior-Surface-Cleaner-with-Hose-Sprayer-2-Pack-SFSRC-2Q/20208617?AID=10368321&PID=3348536&SID=popshops&cm_mmc=CJ-_-3348536-_-10368321&cj=true (Accessed Dec. 15, 2015).
"E-Z House Wash Hose End 56 oz.," http://www.homearmor.com/product/e-z-wash-hose-end (Accessed Jan. 2016).
"Liquid-Plumr Clorox 17 oz.," http://www.harwareandtools.com/clorox-00216-liquid-plumr-17-ounce-foam-udjb-5169.html (Accessed Dec. 10, 2015).
"Resolve Oxi-Action Dual Power Pre-Treat Laudry Stain Remover," http:/rbnainfo.com/productpro/ProductSearch.do?brandID=28&productLineID=502&searchType=PL&template=1 (Accessed Dec. 10, 2015).
"Dual Chamber Sprayer Matrix ASR," http://www.jondon.com/dual-chamber-sprayer-for-matrix-asr.html (Accessed Dec. 10, 2015).
"Red Relief Stain Magic Dual Chamber Trigger Sprayer," http://www.proschoice.com/html/red_r_dual_chamber.html (Accessed Dec. 10, 2015).
"Liquid-Plumbr Foaming Clog Fighter," https://www.liquidplumr.com/products/foaming-clog-fighter (Accessed Dec. 10, 2015).
U.S. Appl. No. 29/646,925, filed May 8, 2018.
U.S. Appl. No. 15/974,246, filed May 8, 2018.

* cited by examiner

SECTION A-A

DUAL SPRAYER, AND DUAL SPRAYER WITH DUAL CHAMBER BOTTLE

PRIORITY STATEMENT

This application claims priority under 35 U.S.C. § 119(e) to provisional U.S. application No. 62/285,002 filed on Dec. 9, 2015, the entire contents of which is incorporated herein by reference in its entirety.

BACKGROUND OF THE INVENTION

Field of the Invention

Example embodiments relate generally to a sprayer, and a sprayer attached to a dual chamber bottle, where the sprayer is capable of selectively discharging two different fluids from the bottle.

Related Art

A sprayer may be used to discharge a fluid, such as a chemical, from a bottle. The sprayer may use a vacuum force to draw the fluid from the bottle, where this vacuum force may be created by a working fluid flowing through the sprayer, such that the sprayer may operate as an injector. The sprayer may therefore discharge a mixture of the working fluid and the fluid from the bottle.

A number of consumer-product applications may benefit from the application and use of more than one fluid and/or chemical. For instance, in the field of consumer automotive products, the application of two or more chemicals, such as a cleaning agent and a spray wax, may be of great value. Other applications (including industrial applications) for surface cleaning, surface preparation, construction, lawn care, painting, manufacturing, etc., may also greatly benefit from the application and use of two or more fluids and/or chemicals. These applications may also benefit from the convenience of spraying these fluids/chemicals onto surfaces and/or objects.

SUMMARY OF INVENTION

At least one example embodiment relates to a sprayer.

In one embodiment, the sprayer includes a housing defining a chamber; a cylinder within the chamber, the cylinder defining more than one discharge tube positioned in a longitudinal direction within the housing, the cylinder being selectively rotatable within the chamber; more than one suction tube extending from a lower portion of the housing, the more than one suction tube being in selective fluid communication with the more than one discharge tube of the cylinder as the cylinder is rotated within the chamber.

In one embodiment, the sprayer further includes more than one suction housing within the cylinder, each suction housing including, one of the more than one discharge tubes, and one suction channel intersecting the respective one discharge tube of the suction housing, each suction channel being in selective fluid communication with one of the more than one suction tubes, the housing defining an inlet, and a central passage near the inlet of the housing, each of the more than one discharge tubes being individually and selectively aligned to be in fluid communication with the central passage as the cylinder is rotated within the chamber.

In one embodiment, the sprayer further includes a screw penetrating a back-wall of the cylinder and a back-wall of the chamber, the screw being configured to retain the cylinder within the chamber during an operational use of the sprayer.

In one embodiment, the back-wall of the chamber defines a first cylindrical extension, the back-wall of the cylinder defines a second cylindrical extension, the first cylindrical extension being insertable into the second cylindrical extension, and the screw penetrates the first and second cylindrical extensions, the screw being configured to remain in a stationary position as the cylinder is rotated within the chamber.

In one embodiment, the more than one discharge tube includes a first discharge tube, a second discharge tube, and a third discharge tube, the more than one suction housing includes, a first suction housing including the first discharge tube in fluid communication with a first suction channel, the first suction channel being in selective fluid communication with a first suction tube, of the more than one suction tubes, and a second suction housing including the second discharge tube in fluid communication with a second suction channel, the second suction channel being in selective fluid communication with a second suction tube, of the more than one suction tubes, the third discharge tube not including a suction housing.

In one embodiment, each suction housing further defines at least one air return vent located adjacent to the respective suction channels of each suction housing, each of the at least one air return vents being in fluid communication with an air inlet that penetrates an end of each suction housing, each of the at least one air return vents being in selective fluid communication with a respective air port positioned adjacent to the suction tubes on the lower portion of the housing.

In one embodiment, the first suction channel is about perpendicular to first discharge tube, the second suction channel is about perpendicular to second discharge tube, a longitudinal length of the central passage is about parallel to the longitudinal direction of the discharge tubes within the housing.

In one embodiment, the sprayer includes multiple operational modes depending on the rotation of the cylinder within the chamber, the multiple operational modes including, a first mode where the first discharge tube is aligned with the central passage and is in fluid communication with the first suction tube, in order to allow the sprayer to accept a pressurized working fluid to enter the inlet of the housing and pass through the first discharge tube to also draw a first liquid fluid into the first discharge tube from the first suction tube, and a second mode where the second discharge tube is aligned with the central passage and is in fluid communication with the second suction tube, in order to allow the sprayer to accept the pressurized working fluid to enter the inlet of the housing and pass through the second discharge tube to also draw a second liquid fluid into the second discharge tube from the second suction tube.

In one embodiment, the multiple operational modes further include, a third mode where the third discharge tube is aligned with the central passage, in order to allow the sprayer to accept the pressurized working fluid to enter the inlet of the housing and pass through the third discharge tube so that the pressurized working fluid may be discharged from the sprayer without being mixed with another liquid fluid, and a fourth mode that does not allow any fluid to travel through the sprayer.

In one embodiment, the sprayer further includes a rotatable dial on an end of the cylinder and positioned to extend from the chamber of the housing, the rotatable dial being capable of manual manipulation to cause the cylinder to rotate within the chamber, indicia on an outer surface of the housing and positioned near the rotatable dial, the indicia indicating which one of the multiple operational modes the sprayer is in.

In one embodiment, the sprayer further includes a multi-chamber bottle connected to the lower portion of the housing, each of the more than one suction tubes extending into one respective chamber of the multi-chamber bottle, the number of chambers of the multi-chamber bottle equaling a number of suction housings within the cylinder of the sprayer.

In one embodiment, the sprayer further includes a dual-chamber bottle connected to the lower portion of the housing, the first suction tube extending into a first chamber of the bottle and the second suction tube extending into the second chamber of the bottle.

In one embodiment, the sprayer further includes a female connector on the lower portion of the housing, the female connector including at least one first engaging structure on an inner surface of the female connector, the first and second suction tubes emanating from the confines of the female connector to extend into the bottle.

In one embodiment, the sprayer further includes a male connector on a top portion of the bottle, the male connector including at least one second engaging structure on an outer surface of the male connector that is mateable with the at least one first engaging structure on the female connector, the bottle including a divider, extending from a bottom floor of the bottle up to the female connector of the bottle, that divides the bottle into the first chamber and the second chamber.

In one embodiment, the at least one first engaging structure includes at least one physical stop on the inner surface of the female connector, the at least one second engaging structure includes at least one depression positioned on the outer surface of the male connector, the at least one depression being capable of accepting and retaining the at least one physical stop of the first engaging structure.

In one embodiment, the at least one first engaging structure includes three physical stops equally spaced apart on the inner surface of the female connector, the at least one second engaging structure includes two depressions positioned on the outer surface of the male connector, each of the depressions being capable of accepting and retaining one of the physical stops on the female connector, the at least one second engaging structure further includes a rib extending along a portion of an outer circumference of the male connector.

In one embodiment, the rib extends about 0.35 radians to 0.52 radians along the outer circumference of the male connector so that the female connector can be rotated about 30 degrees or less in order to respectively seat two of the physical stops within the two depressions, in order lock the female connector onto the male connector while the third physical stop is retained under the rib.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
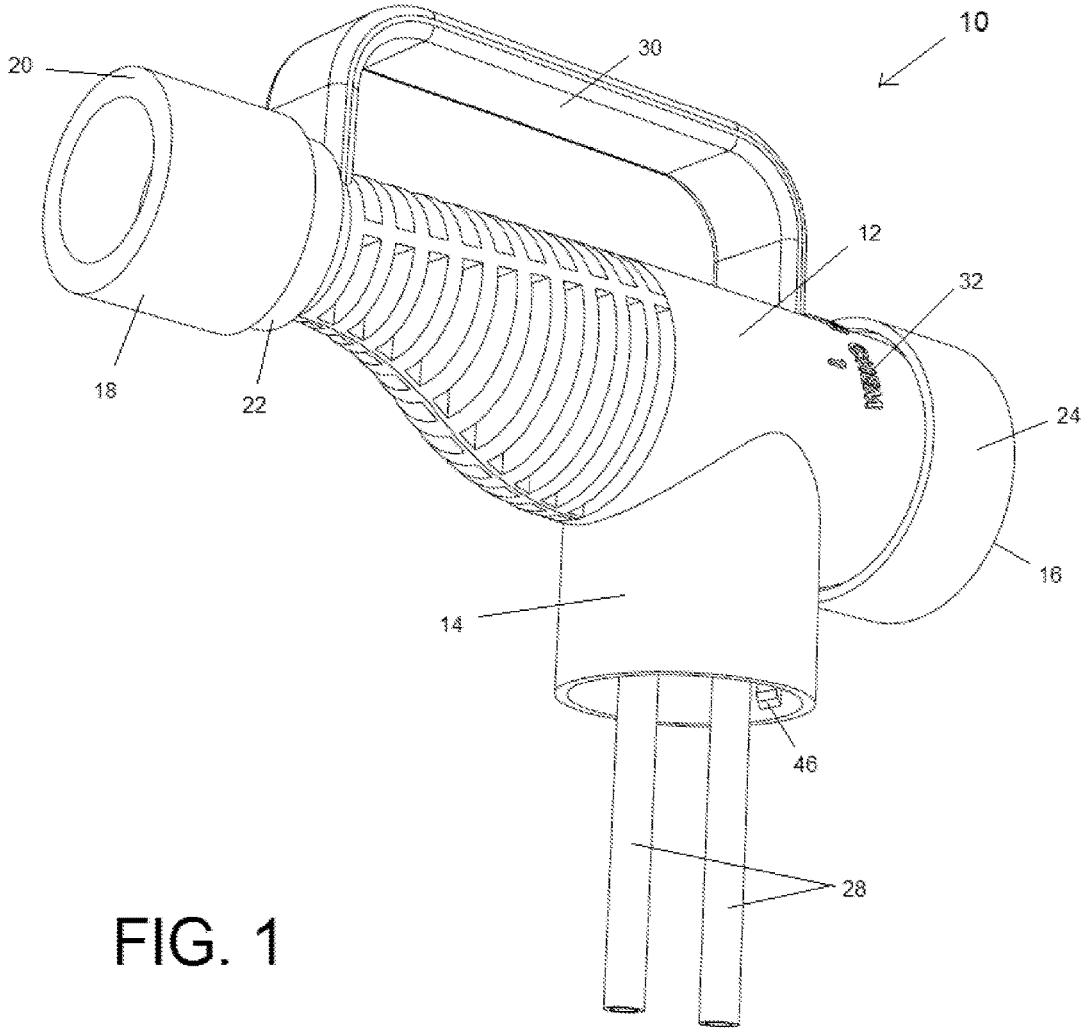
FIG. 1 is an illustration of a perspective view of a dual sprayer, in accordance with an example embodiment.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIG. 1 is an illustration of a perspective view of a dual sprayer 10, in accordance with an example embodiment. The dual sprayer 10 may be used to discharge more than one fluid and/or chemical, along with a working fluid (such as water). The sprayer 10 may include a major housing 12 with a water inlet end 22 and a sprayer outlet end 16. The water inlet end 22 may include an adapter 18 that may, for instance, be a quick-connect adapter, or another well-known adapter that allows a water source to be connected to the water inlet end 22. Specifically, the water inlet end 22 may have an interface 20 that connects to a garden hose (not shown), or another fluid source, allowing the end 22 to accept a pressurized working fluid that may travel through the housing 12 in order to be discharged at the sprayer outlet 16.

Figure 3:
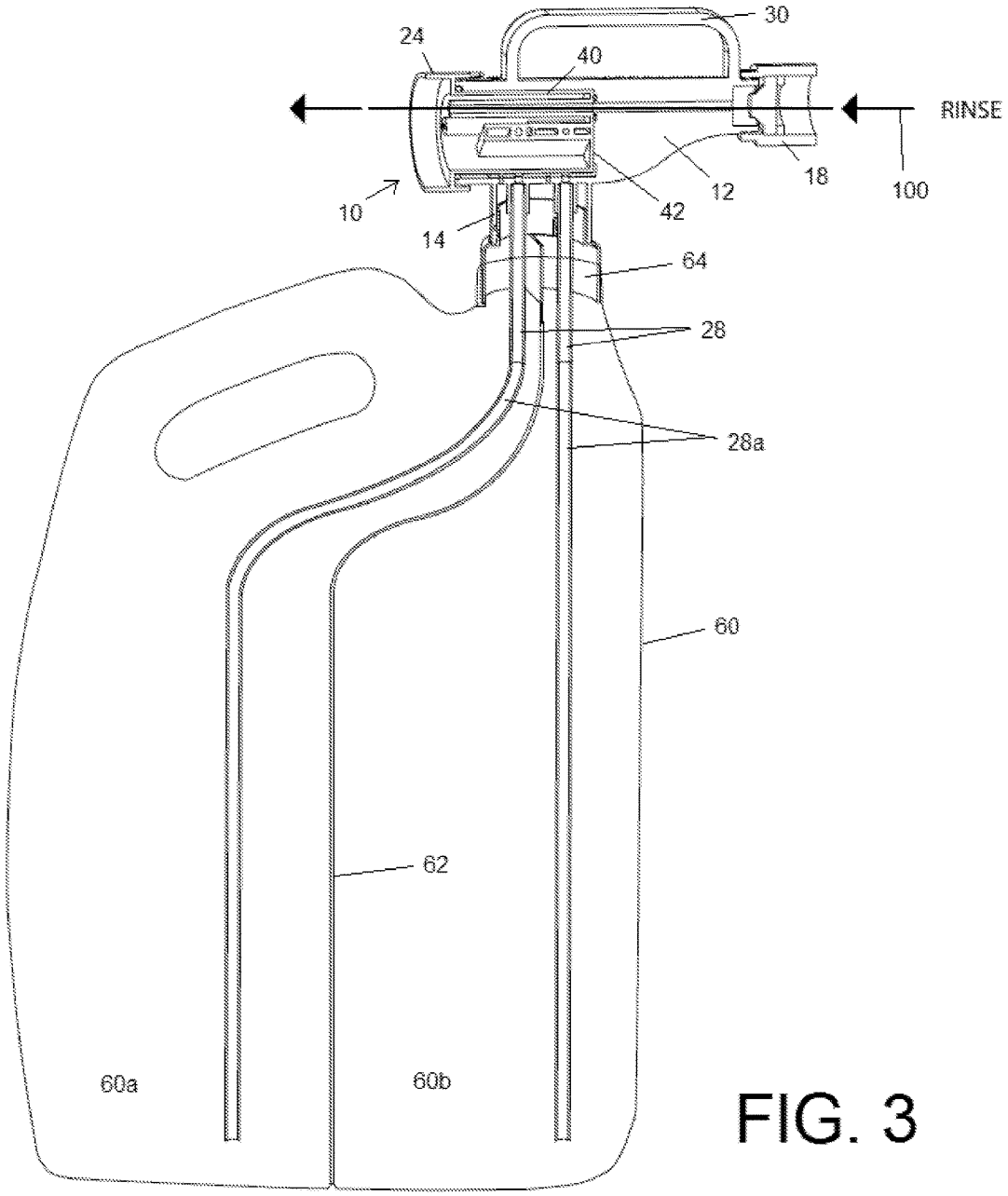
FIG. 3 is an illustration of a cross-sectional side-view of a dual sprayer connected to a dual chamber bottle, in accordance with an example embodiment.

The sprayer 10 may also include a connector 14 that may attach to a bottle 60 (see FIG. 3). The bottle 60 may, for instance, be a dual chamber bottle that may include two or more separated chambers that may each hold a fluid and/or chemical. More than one suction tube 28 may extend from within the connector 14, where a distal end of each of the suction tubes 28 may be positioned within one of the chambers of the bottle 60 (as shown in FIG. 3) in order to allow the sprayer 10 to draw fluid from the bottle 60. One or more physical stops 46 on the connector 14 may be included within an inner surface of the connector 14 in order to attach the sprayer 10 to the bottle 60 (as described in greater detail, herein).

Figure 2:
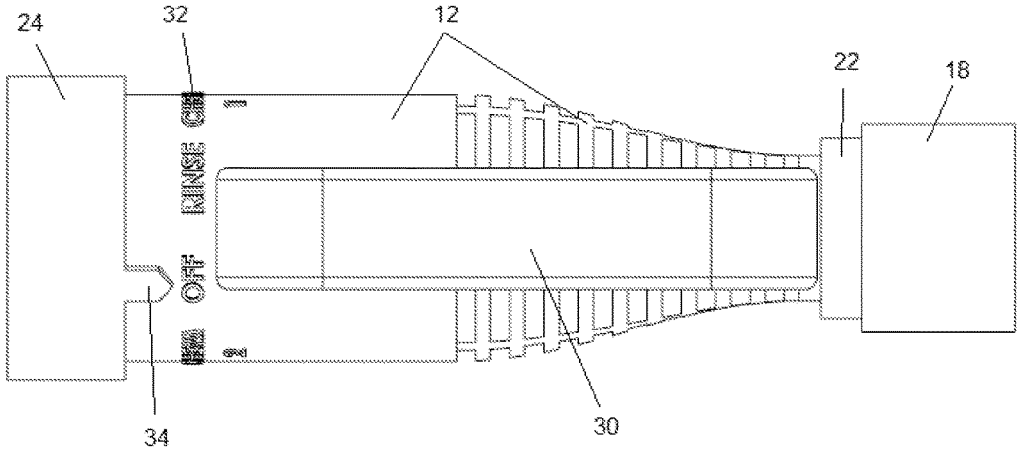
FIG. 2 is an illustration of an overhead view of a dual sprayer, in accordance with an example embodiment.

The sprayer 10 may include a rotating dial 24 that allow the sprayer 10 to be transitioned into different "modes," as described in more detail in FIG. 2. Indicia 32 may be included on the housing 12 in order to signify which mode the sprayer 10 is in. The sprayer may include a handle 30 in order to facilitate easy transport and use of the sprayer 30, especially in the event that the sprayer 10 is attached to a bottle that may be relatively heavy.

FIG. 2 is an illustration of an overhead view of the dual sprayer 10 of FIG. 1, in accordance with an example embodiment. The rotating dial 24 may include a marker 34 that may be used to indicate which "mode" the sprayer 10 is in. The sprayer 10 may include, for instance, four or more modes (indicated by indicia 32), where these modes may be: 1. Off (where the sprayer 10 does not discharge any fluid), 2. A rinse mode (that only discharges the working fluid, which may for instance be water), 3. A "chem 1" mode (where the sprayer 10 may discharge a mixture of the working fluid and a fluid and/or chemical from chamber "A" 60*a* of bottle 60, as shown in FIG. 3), and 4. A "chem 2" mode (where the sprayer 10 may discharge a mixture of the working fluid and another fluid and/or chemical from chamber "B" 60*b* of bottle 60, as shown in FIG. 3). These different modes are described in conjunction with the specific structural components of the sprayer 10, in greater detail below.

FIG. 3 is an illustration of a cross-sectional side-view of the dual sprayer 10 connected to a dual chamber bottle 60, in accordance with an example embodiment. In FIG. 3, the sprayer 10 is shown in a rinse mode, where only the working fluid 100 is capable of flowing through the sprayer (where the rinse mode is shown in even better detail in conjunction with the discussion of FIG. 14). The sprayer 10 may include a rotatable cylinder 40 that may rotate within a socket (cavity) 42 of the housing 12 of the sprayer 10. The cylinder 40 may be connected to the rotating dial 24 in order to allow the sprayer 10 to change modes.

The connector 14 of the sprayer 10 may be a female connector that may be capable of attaching to a male connector 64 of the bottle 60 (as described in more detail herein). Extension tubes 28*a* may be connected to the ends of the suctions tubes 28 in order to allow the sprayer 10 to take suction toward a bottom of the bottle 60. While the bottle 60 may include a single divider 62 separating the bottle into two chambers (chamber "A" 60*a* and chamber "B" 60*b*), it should be understood that the bottle 60 may also include more than two chambers.

Figure 4:
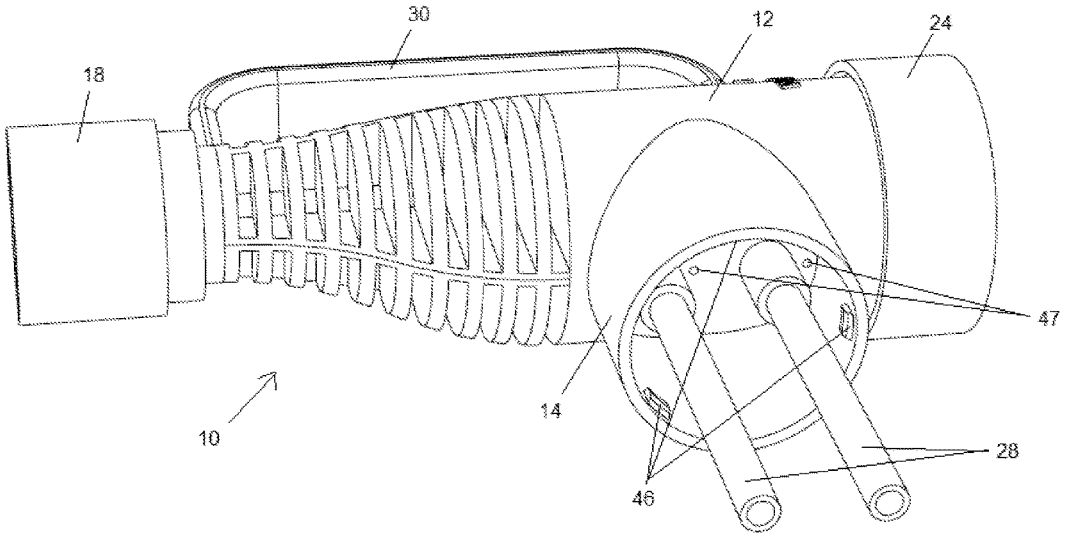
FIG. 4 is an illustration of a perspective view, from a bottom view, of a dual sprayer, in accordance with an example embodiment.

FIG. 4 is an illustration of a perspective view, from a bottom view, of the dual sprayer 10, in accordance with an example embodiment. The connector 14 may include, for instance, three physical stops 46 that may be spaced equidistantly around the inner surface of the connector 14. The physical stops may be beveled, from the standpoint that the stops 46 may be raised, but the stops may become tapered at an end that approaches a distal end of the connector 14.

Figure 6:
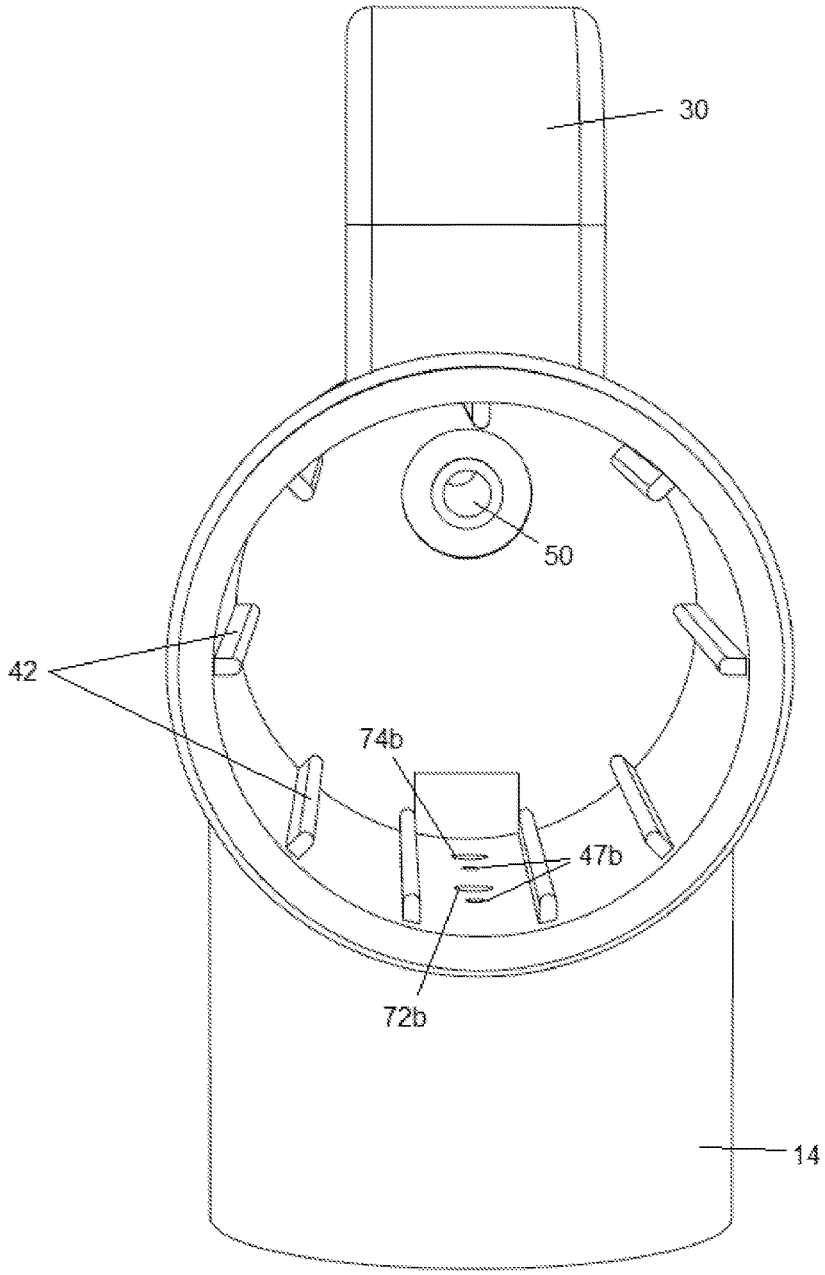
FIG. 6 is an illustration of internals of a main housing of a dual sprayer, in accordance with an example embodiment.

A bottom surface of the housing 12, that may be above a location of the connector 14, may include one or more air return ports 47 that may be in fluid communication with one or more air ports 47*b* shown in FIG. 6. The air return ports 47 may allow air to enter the bottle 60 as fluid is displaced from the bottle 60 while the sprayer 10 is in functional use.

Figure 5A:
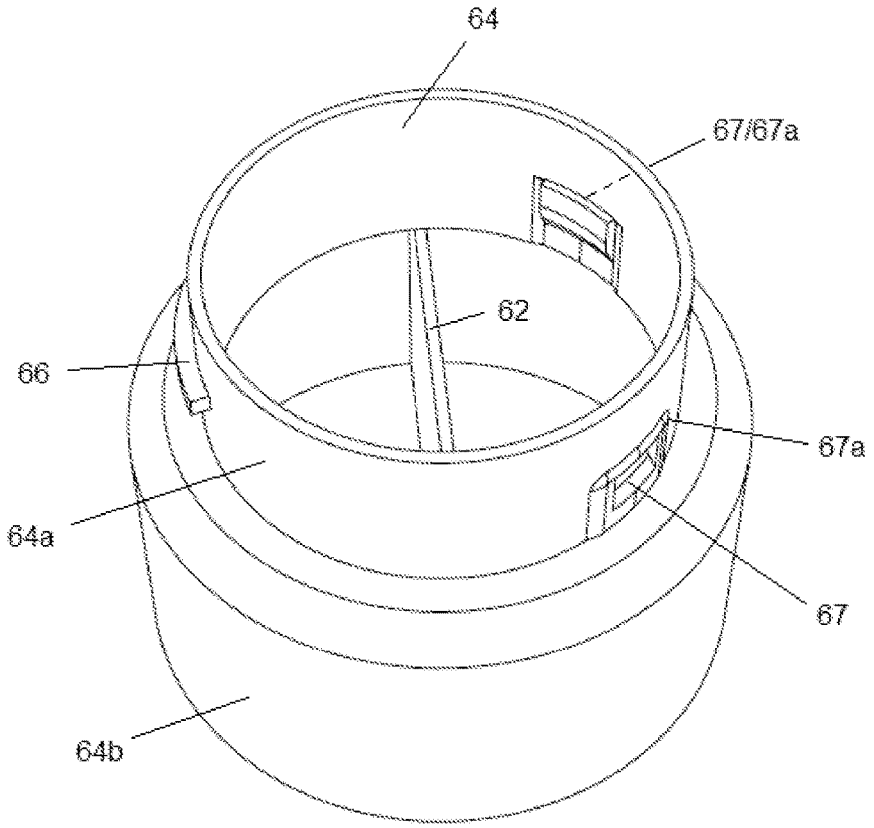
FIG. 5A is an illustration of a male connector at the top of a dual chamber bottle, in accordance with an example embodiment.

FIG. 5A is an illustration of a male connector 64 at the top of a neck 64*b* of a bottle 60, such as a dual chamber bottle, in accordance with an example embodiment. The male connector 64 may include two or more depressions 67 that may mate with the beveled stops 46 of the connector 14 of the sprayer 10. The depressions 67 may include a raised-frame 67*a* capable of retaining the stops 46 with the depressions 67.

The male connector 64 may also include a rib 66 positioned along a portion of an outer circumference of the connector 64. The rib 66 may be positioned to allow one of the physical stops 46 of the connector 14 of the sprayer 10 to slide under the rib 66, and be retained by the rib 66 (also see the position of the rib in FIG. 5B), thereby providing at least three points-of-contact to lock the sprayer connector 14 onto the male connector 64 of the bottle 60. The rib 66 may have a limited length (discussed below with regard to FIG. 5B) in order to allow a physical stop 46 to slide down along an outer surface 64*a* of the bottle connector 64, and then slide under the rib 66 (and be retained under the rib 66 to impede the connector 14 of the sprayer 10 from separating from the bottle 60), such that the connector 14 of the sprayer 10 may only need to be rotated within a limited range of rotation in order to lock the sprayer 10 onto the bottle 60. In particular, the rib 66 may have a limited length in order to require that the connector 14 of the sprayer 10 may only need to rotate about 30 degrees, or less, as the connector 14 of the sprayer 10 is pressed down onto the connector 64 of the bottle 60 and rotated into a locked position. This limited required angular rotation of the connector 14 on the male connector 64 of the bottle 60 ensures that the suction tubes 28 may be retained on the bottom of the sprayer 10 without being damaged or broken (as a greater required degree of rotation between the connector 14 of the sprayer 10 and the male connector 64 of the bottle 60 may cause the suction tubes 28 to contact the divider 62 and may cause damage to the suction tubes 28).

Figure 5B:
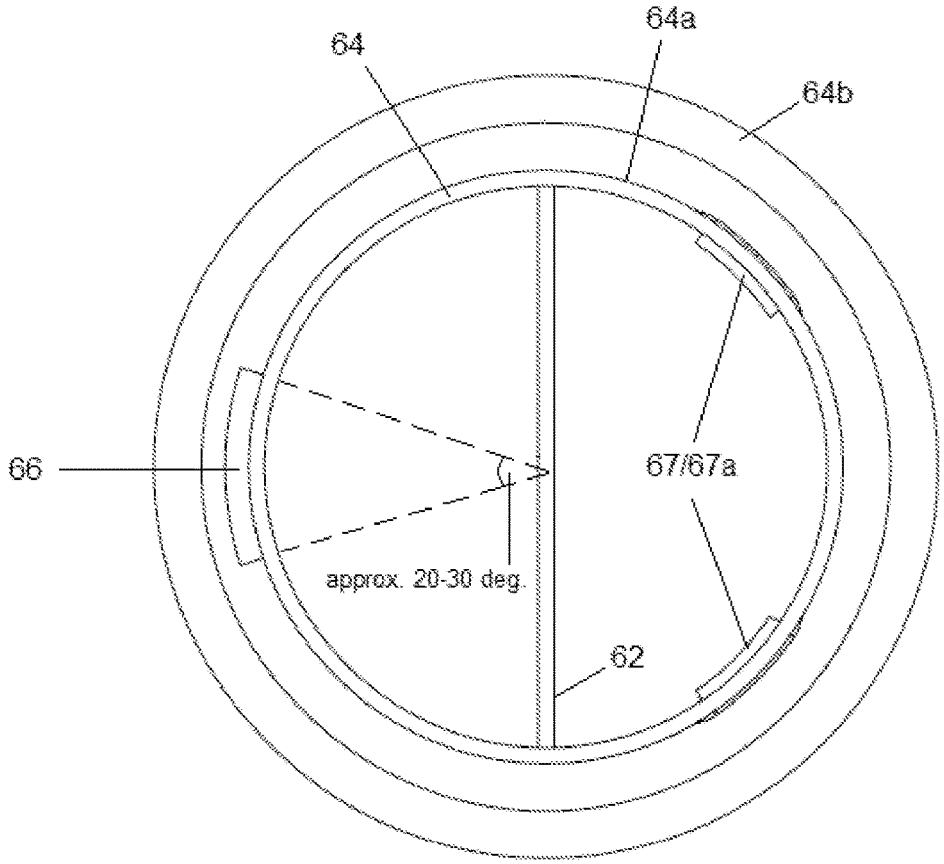
FIG. 5B is an illustration of an overhead view of a male connector at the top of a dual chamber bottle, in accordance with an example embodiment.

FIG. 5B is an illustration of an overhead view of the male connector 64 at the top of 60 dual chamber bottle, in accordance with an example embodiment. Notice that FIG. 5B depicts a relative length of rib 66. In particular, the rib 66 may be positioned to exist along about 20 to 30 degrees of the outer circumference of the male connector 64 (i.e., the rib 66 may extend about 0.35 radians to 0.52 radians along the outer circumference of connector 64), in order to limit the required angle of rotation that may be necessary to slip one of the physical stops 46 of the connector 14 of the sprayer 10 under the rib 66 and rotate the connector 14 about 30 degrees or less in order to seat the other physical stops 46 within the depressions 67 and frame 67*a* of the male connector 64 (thereby locking the sprayer 10 onto the top of the bottle 60).

It should be understood that other embodiments have been contemplated, where additional physical stops 46 may be included on the connector 14 of the sprayer, and where additional depressions and/or ribs 66 may be included on a male connector 64 of a bottle. Additionally, it is noted that any of a great variety of bottles may be used, where the dual chamber bottle 60 (shown in FIG. 3) is just one example of a bottle with more than one chamber. Furthermore, while the female connector 14 of the sprayer 10 and the male connector 64 of the bottle 60 have been depicted with a circular cross-section, it should be understood that example embodiments allow for other cross-sectional shapes may instead be implemented. In particular, square or rectangular connectors may be implemented (or, square or rectangular connectors with rounded-corners may be implemented).

FIG. 6 is an illustration of internals of the main housing 12 of a dual sprayer 10, in accordance with an example embodiment. The housing may include a socket (chamber) 42 that may contain the rotatable cylinder (valve) 40 of the sprayer 10. The housing 12 may also include a central passage 50 that may exist between the socket 42 and the inlet end 22 of the sprayer 10 (in order to allow the working fluid to traverse through the inside of the housing 12). Near a bottom of the socket 42 (at a location above the connector 14), the housing may include air ports 47*b* in fluid communication with the air return ports 47. The air ports 47*b* may allow air to enter into the bottle 60 while fluid is displaced from the bottle 60 while the sprayer 10 is in use. The bottom of the socket 42 may also include two or more ports, such as a "chemical 1" port 72*b* and "chemical 2" port 74*b*, that may allow fluid from the bottle 60 to be drawn into the sprayer 10.

An inner surface of the socket 42 may also include ribs 48 that may run longitudinally within the socket 42. The ribs 48 may support the cylinder 40 (shown in detail in FIG. 7), and allow the cylinder 40 to rotate within the socket 42.

Figure 7:
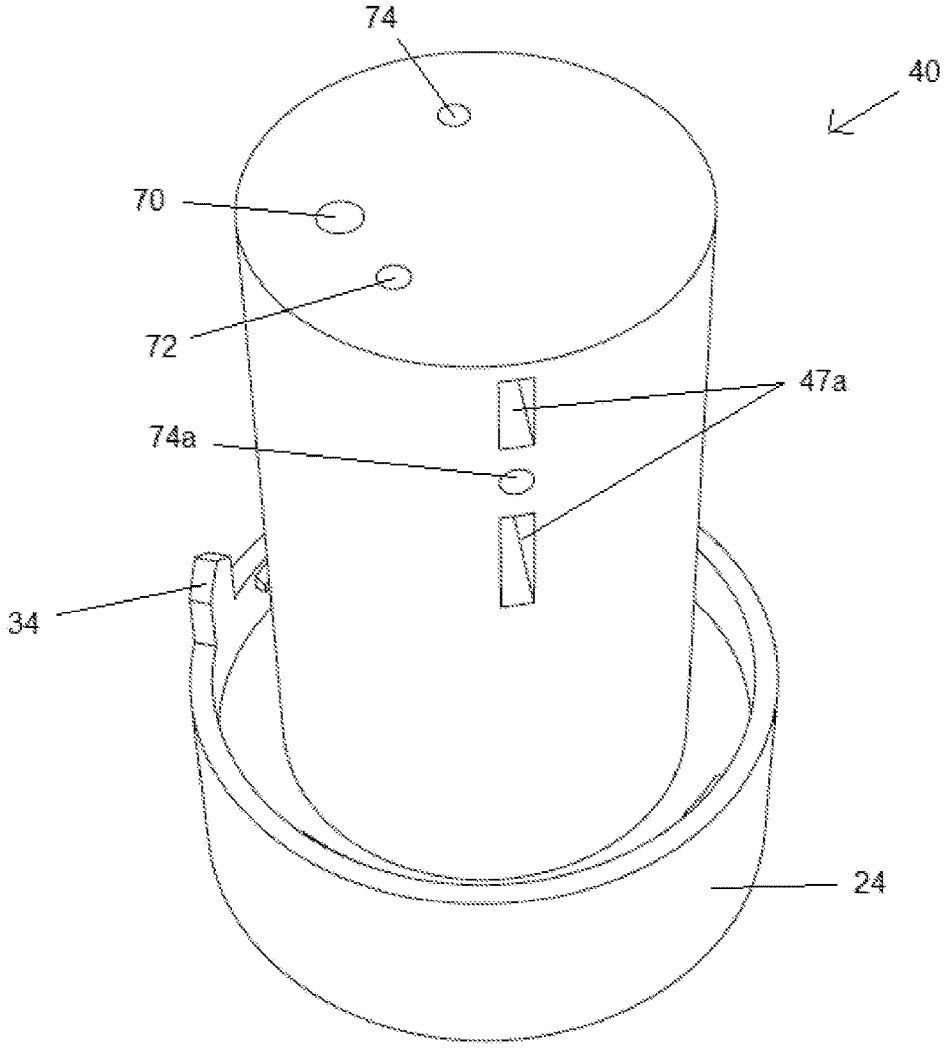
FIG. 7 is an illustration of an end-view of a cylinder of a dual sprayer, in accordance with an example embodiment.

FIG. 7 is an illustration of an end-view of the cylinder 40 of the dual sprayer 10, in accordance with an example embodiment. The cylinder 40 may include a relatively large diameter water discharge line (port) 70 that may run through a longitudinal length of the cylinder 40 and may be in fluid communication with the water discharge tube 80 on the other side of the cylinder 40 (see FIG. 8). This water discharge line 70 may allow the working fluid to pass through the sprayer 10 during a rinse mode.

Figure 8:
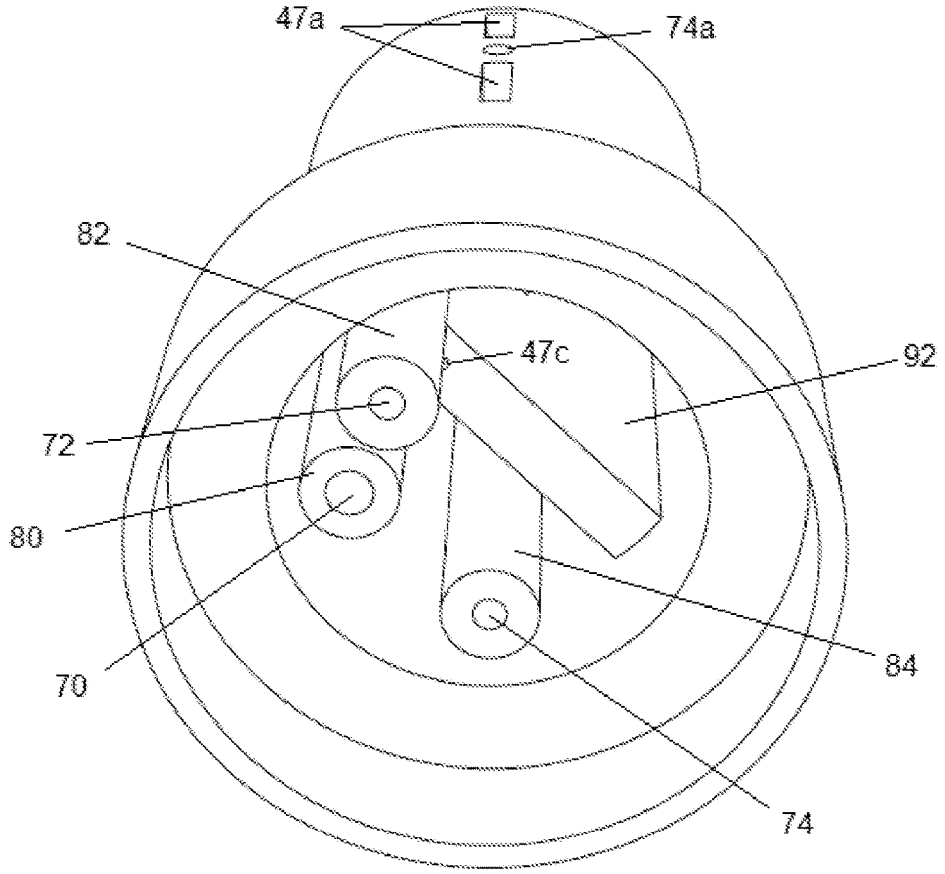
FIG. 8 is an illustration of another end-view of a cylinder of a dual sprayer, in accordance with an example embodiment.

The cylinder 40 may also include a relatively smaller diameter "chemical 2" discharge line 74 that may run through a longitudinal length of the cylinder 40 and may be in fluid communication with the "chemical 2" discharge tube 84 on the other side of the cylinder 40 (see FIG. 8). This "chemical 2" discharge line 74 may allow the working fluid to mix with a fluid that may be drawn from a chamber of the bottle 60. Specifically, the working fluid flowing through the "chemical 2" discharge line 74 may cause a vacuum force within a "chemical 2" suction channel 74*a* that is in fluid communication with the "chemical 2" discharge line 74, allowing the cylinder 40 to act as an injector in order to draw a fluid from a chamber of the bottle 60 when the "chemical 2" suction channel 74*a* is aligned with the "chemical 2" port 74*b* (FIG. 6) in the "chem 2" mode of the sprayer 10. In this mode, one or more air return vents 47*a* may also be aligned with the air ports 47*b* in the housing (FIG. 6) in order to allow air to flow into the bottle as a fluid is discharged from the bottle 60.

Figure 9:
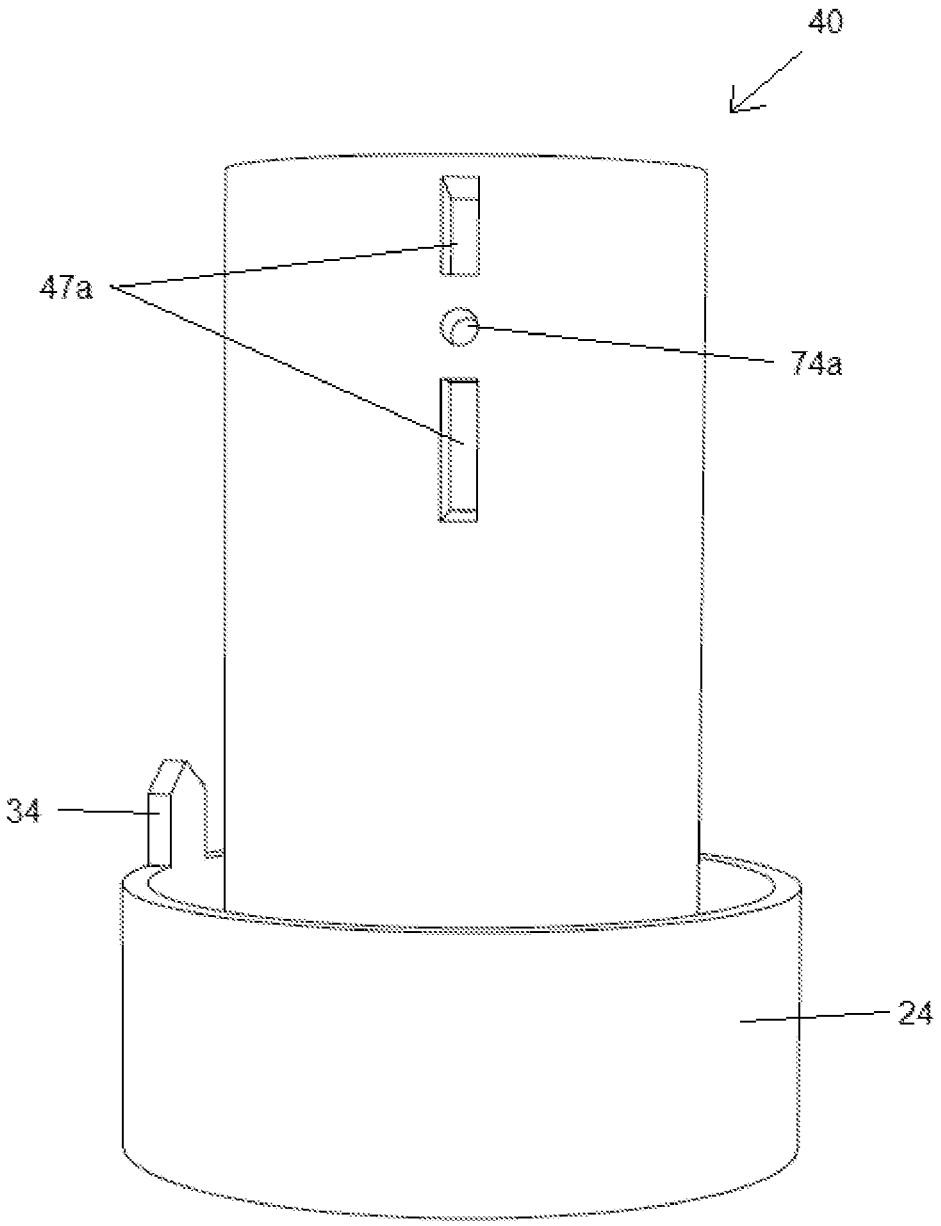
FIG. 9 is an illustration of a side-view of a cylinder of a dual sprayer, in accordance with an example embodiment.

The cylinder 40 may also include a "chemical 1" discharge line 72 in fluid communication with the "chemical 1" discharge tube (FIG. 8), where the function of this line 72 is described in greater detail in association with FIG. 9.

FIG. 8 is an illustration of another end-view of the cylinder 40 of the dual sprayer 10, in accordance with an example embodiment. Note that this drawing depicts a "chemical 1" suction housing 92 (also shown in FIG. 13). This housing 92 may define the "chemical 1" suction channel 72*a* and the air return vents 47*a* (shown in better detail in FIG. 9). The air return vents 47*a* may be in fluid communication with the air inlet 47*c* of the "chemical 1" suction housing 92 (see FIG. 13) in order to provide a reverse flow-path of air back into the bottle 60 as fluid is discharged from the bottle 60.

Figure 10:
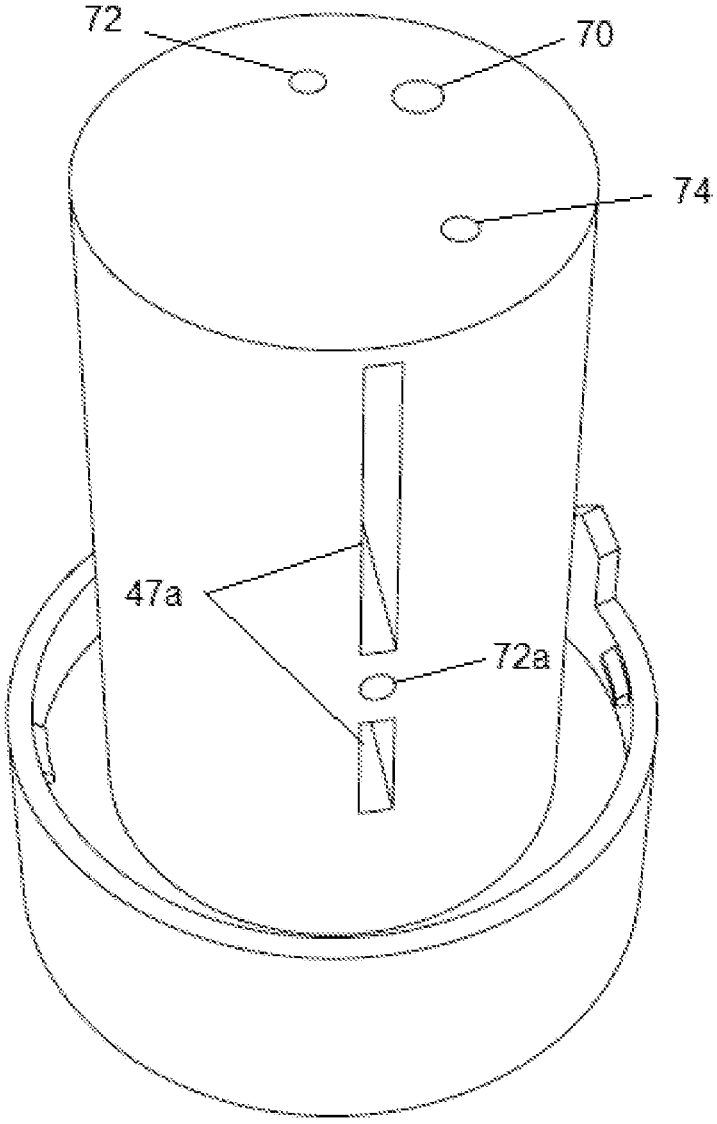
FIG. 10 is an illustration of an end-view of a cylinder of a dual sprayer, in accordance with an example embodiment.
Figure 11:
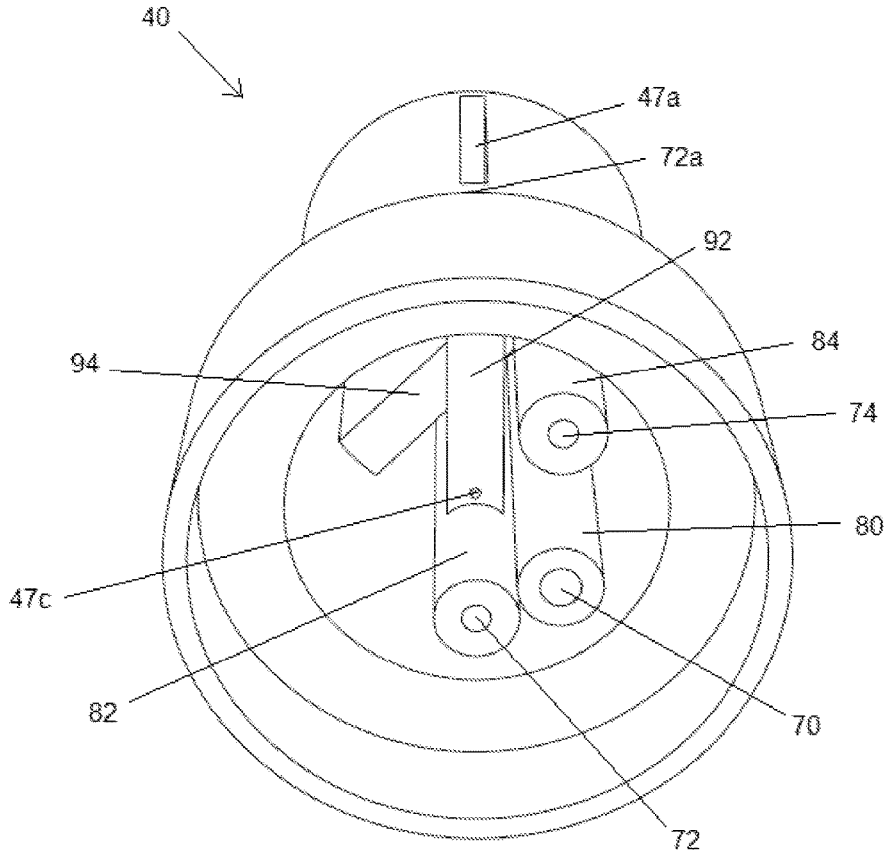
FIG. 11 is an illustration of another end-view of a cylinder of a dual sprayer, in accordance with an example embodiment.

FIG. 10 is an illustration of an end-view of the cylinder 40 of the dual sprayer 10, in accordance with an example embodiment. In particular, FIG. 10 depicts the "chemical 1" suction channel 72*a* that is in fluid communication with the "chemical 1" discharge line 72 that traverses through a longitudinal length of the cylinder 40. The "chemical 1" discharge line 72 is also in fluid communication with the "chemical 1" discharge tube 82 (FIG. 11). When sprayer 10 is discharging fluid from the bottle 60 through the "chemical 1" discharge line 72, the cylinder is rotated within the housing 12 so that the "chemical 1" discharge line 72 is aligned with the central passage 50 (FIG. 6). Note that one or more air return vents 47*a* are also near the "chemical 1" suction channel 72*a*, as these vents 47*a* may be aligned with the air ports 47*b* of the housing 12 (see FIG. 6) in order to allow a reverse air flow to enter the bottle 60 as fluid is being displaced from the bottle.

FIG. 11 is an illustration of another end-view of the cylinder 40 of the dual sprayer 10, in accordance with an example embodiment. This perspective view of the cylinder 40 shows the alignment of a "chemical 1" suction housing 92 with the "chemical 1" suction channel 72*a* and air return vents 47*a* (as both the channel 72 and vents 47*a* are included in the "chemical 1" suction housing 92). It should be understood that the air inlet 47*c* shown exiting the "chemical 1" suction housing 92 is in fluid communication with the air return vents 47*a* in order to provide a reverse flow path of air into the bottle 60 as the sprayer 10 displaces fluid from the bottle 60.

FIG. 11 also depicts the "chemical 2" suction housing 94 that houses the "chemical 2" suction channel 74*a* and the air return vents 47*a* bracketing the "chemical 2" suction channel 74*a* (shown in FIG. 9). The "chemical 2" suction channel 74*a* is in fluid communication with the "chemical 2" discharge tube 84 (also shown in FIG. 13), whereas the air return vents 47*a* adjacent to the "chemical 2" suction channel 74*a* are in fluid communication with the air inlet 47*c* exiting the "chemical 2" suction housing 94 (as shown in FIG. 13).

Figure 12:
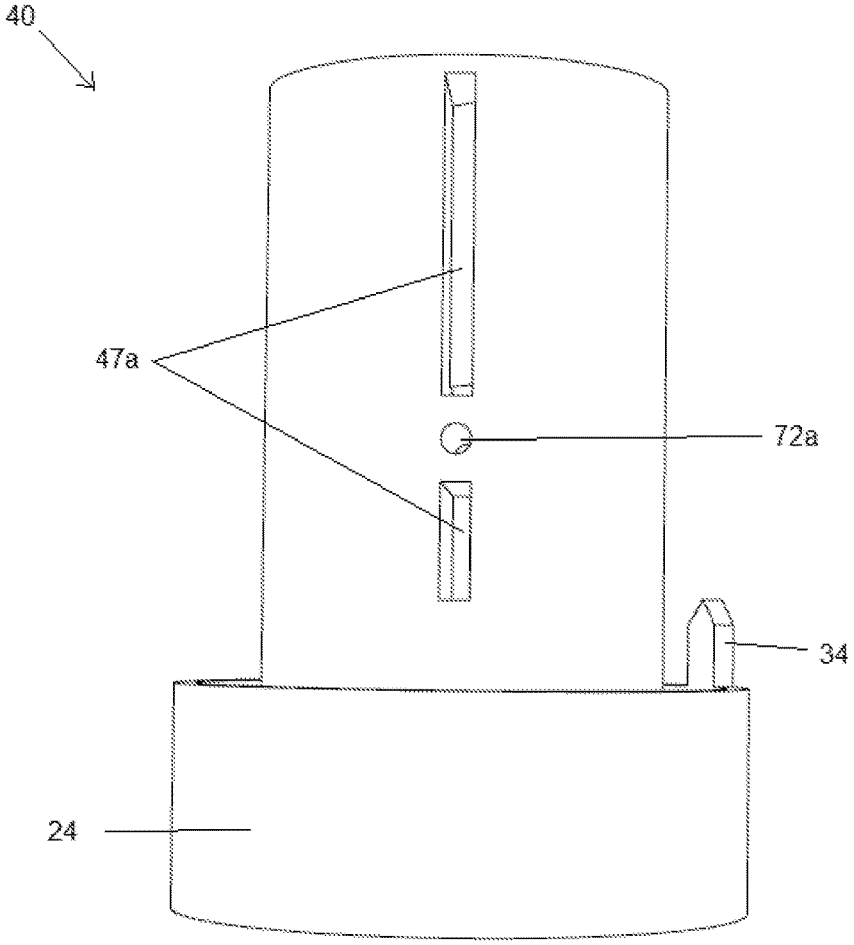
FIG. 12 is an illustration of a side-view of a cylinder of a dual sprayer, in accordance with an example embodiment.

FIG. 12 is an illustration of a side-view of the cylinder 40 of the dual sprayer 10, in accordance with an example embodiment. In particular, FIG. 12 depicts the placement of the "chemical 1" suction channel 72*a* and air return vents 47*a* positioned along the side of the cylinder 40.

Figure 13:
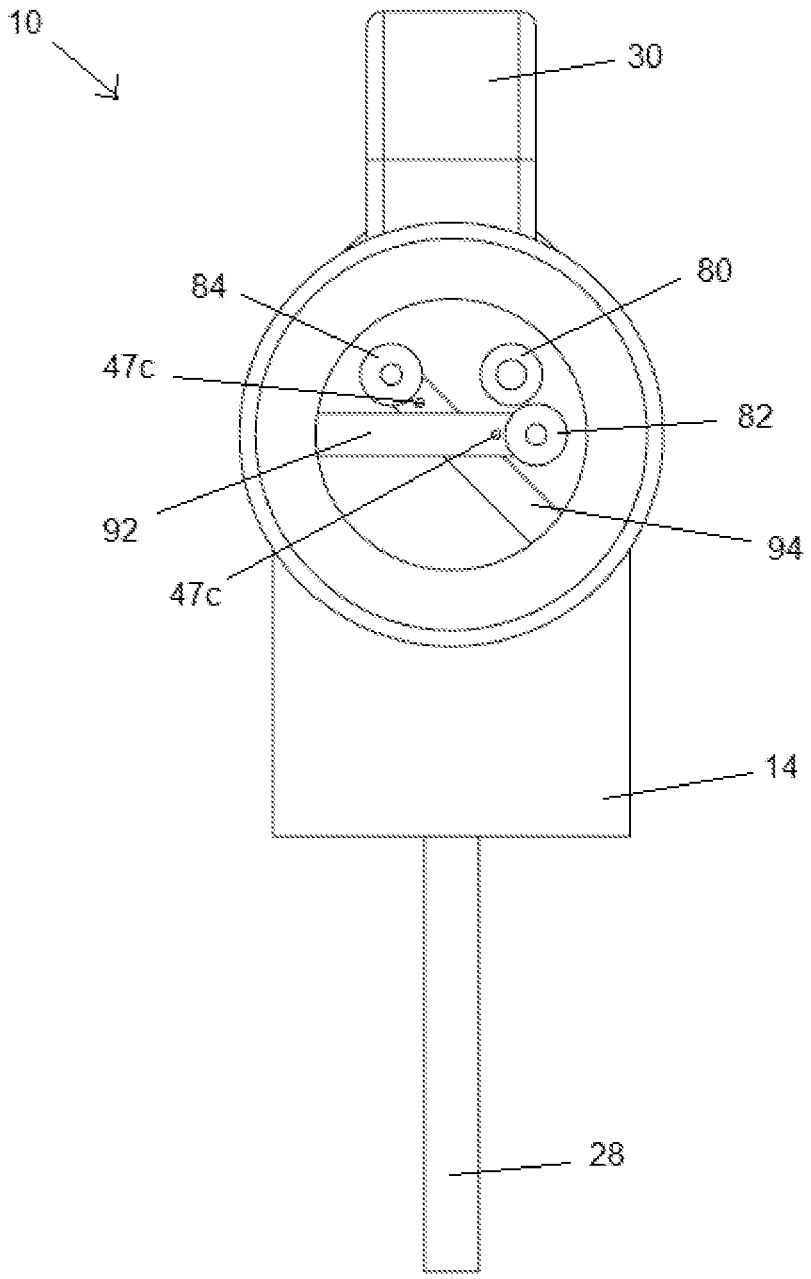
FIG. 13 is an illustration of a discharge end of a dual sprayer, in accordance with an example embodiment.

FIG. 13 is an illustration of a discharge end of the dual sprayer, in accordance with an example embodiment. In particular, FIG. 13 depicts the sprayer 10 in the "off" mode, where the sprayer 10 is unable to discharge either a fluid from the bottle 60, or a working fluid entering from inlet 22. This is because neither the water discharge tube 80, nor the "chemical 1" discharge tube 82 and "chemical 2" discharge tube 84 are aligned with the central passage 50 within the housing (see FIG. 6).

Figure 14:
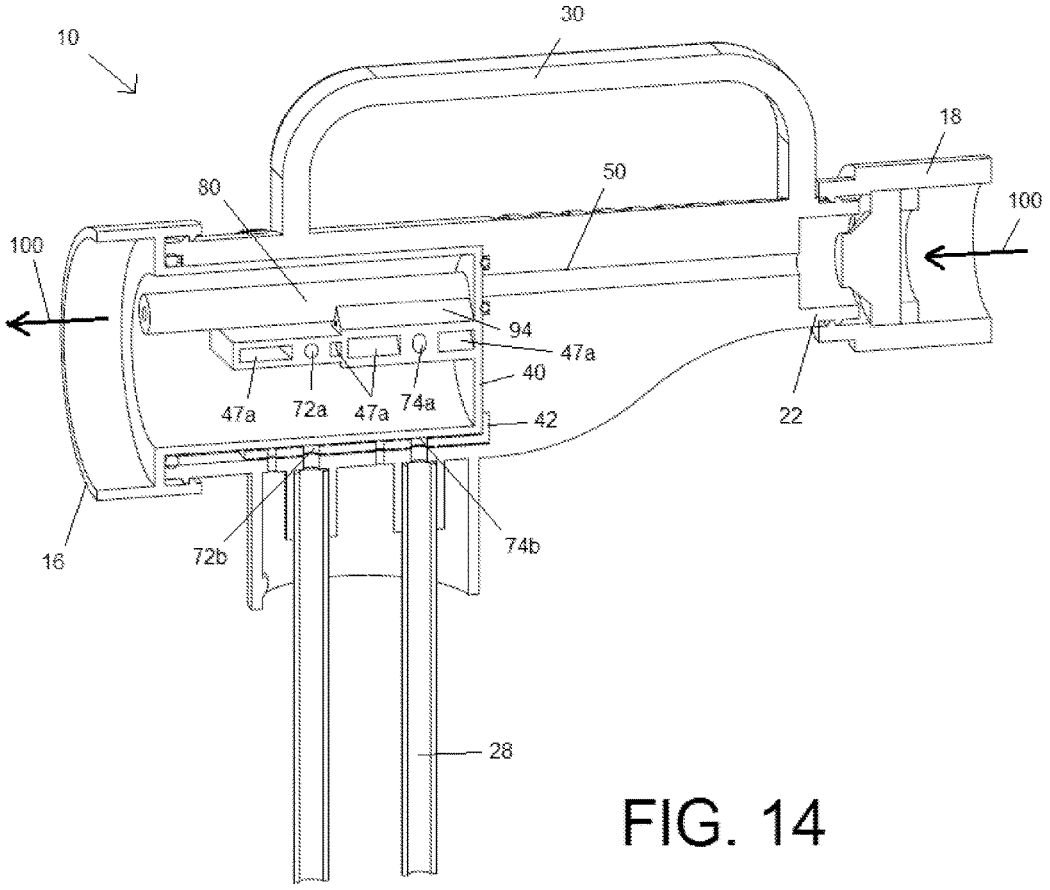
FIG. 14 is an illustration of a cross-section side-view of a dual sprayer in a rinse mode, in accordance with an example embodiment.

FIG. 14 is an illustration of a cross-section side-view of the dual sprayer 10 in a "rinse" mode, in accordance with an example embodiment. Notice that in this mode, the water discharge tube 80 of the cylinder 40 is aligned with the central passage 50 (also shown in FIG. 6), thereby allowing a working fluid 100 to enter the inlet 22 of the sprayer and flow through the sprayer 10 to be discharged at the outlet 16. Notice that in this mode, neither the "chemical 1" suction channel 72*a* nor the "chemical 2" suction channel 74*a* are aligned with the respective "chemical 1"/"chemical 2" ports 72/74*b* (also shown in FIG. 6) that would otherwise allow the sprayer 10 to draw fluid from the suction lines 28.

Figure 15:
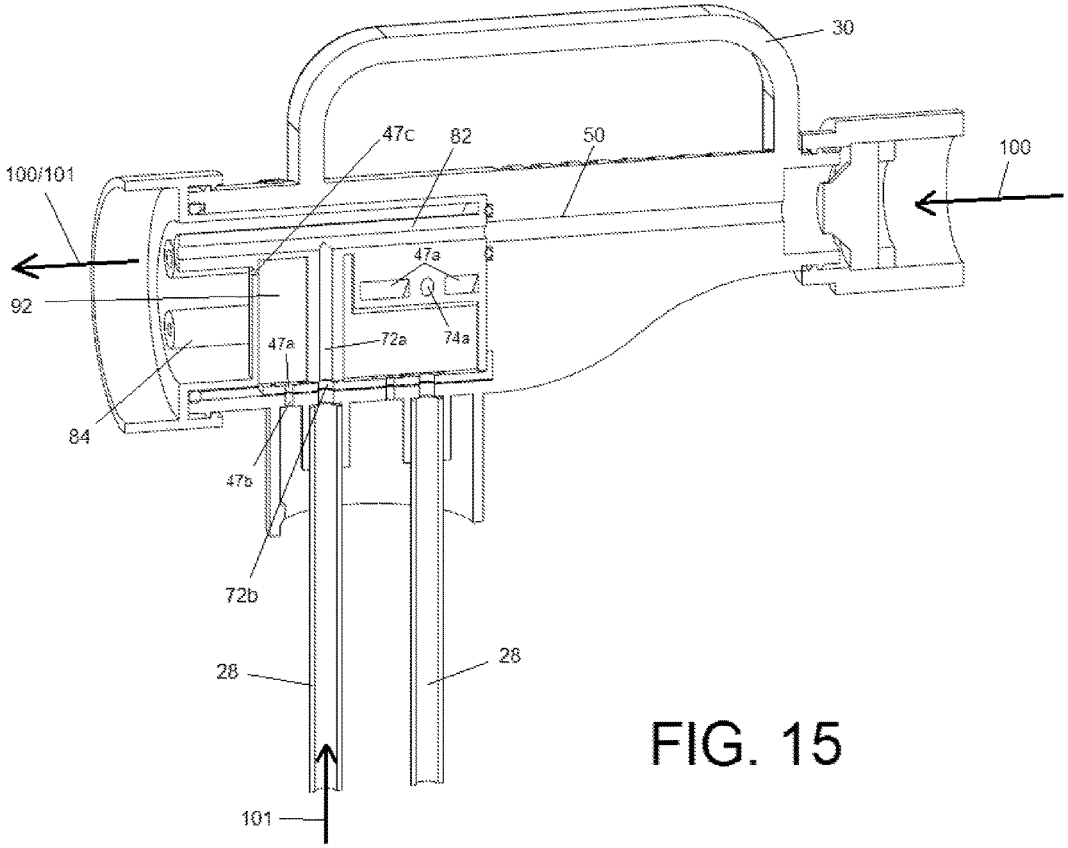
FIG. 15 is an illustration of a cross-section side-view of a dual sprayer discharging a first fluid, in accordance with an example embodiment.

FIG. 15 is an illustration of a cross-section side-view of the dual sprayer 10 discharging a first fluid, in accordance with an example embodiment. Specifically, this drawing depicts a "chem 1" mode, where the "chemical 1" suction channel 72*a* may be aligned with the "chemical 1" discharge tube 82. In this mode, the working fluid 100 may flow through the central passage 50 and the "chemical 1" discharge tube 82, thereby creating a vacuum force (similar to an injector) that allows a fluid 101 to be drawn through one of the suction lines 28 and through "chemical 1" port 72*b* prior to entering "chemical 1" suction channel 72*a* and mixing with the working fluid 100 before being discharged from the sprayer 10. Notice that in this mode, at least one air port 47*b* is aligned with at least one air inlet 47*c* in order to allow a reverse flow of air to travel from air return vent 47*a* into the bottle 60 when the sprayer 10 is locked onto the top of a bottle 60 and the sprayer 10 is in use.

Figure 16:
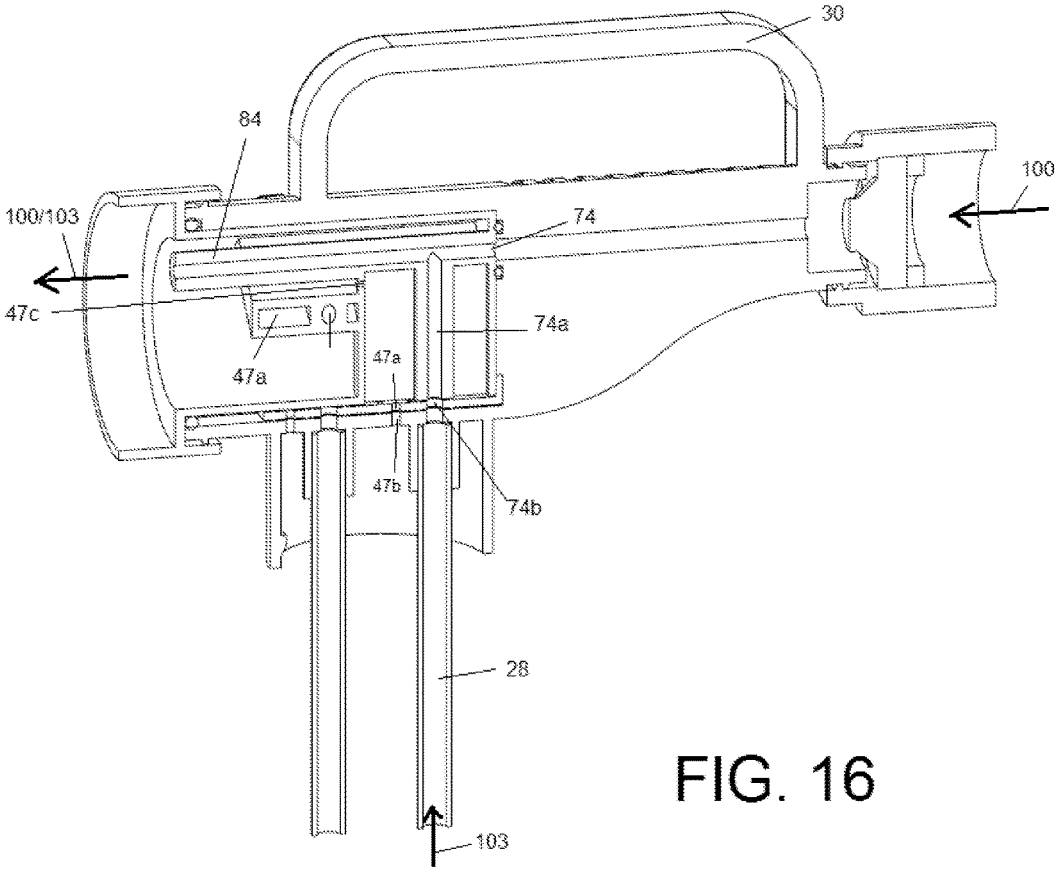
FIG. 16 is an illustration of a cross-section side-view of a dual sprayer discharging a second fluid, in accordance with an example embodiment.

FIG. 16 is an illustration of a cross-section side-view of the dual sprayer 10 discharging a second fluid 103, in accordance with an example embodiment. Specifically, this drawing depicts a "chem 2" mode, where the "chemical 2" suction channel 74*a* may be aligned with the "chemical 2" discharge tube 84. In this mode, the working fluid 100 may flow through the central passage 50 and the "chemical 2" discharge tube 84, thereby creating a vacuum force (similar to an injector) that allows a fluid 103 to be drawn through one of the suction lines 28 and through "chemical 2" port 74*b* prior to entering "chemical 2" suction channel 74*a* and mixing with the working fluid 100 before being discharged from the sprayer 10. Notice that in this mode, at least one air port 47*b* is aligned with at least one air inlet 47*c* in order to allow a reverse flow of air to travel from air return vent 47*a* into the bottle 60 when the sprayer 10 is locked onto the top of a bottle 60 and the sprayer 10 is in use.

Figure 17A:
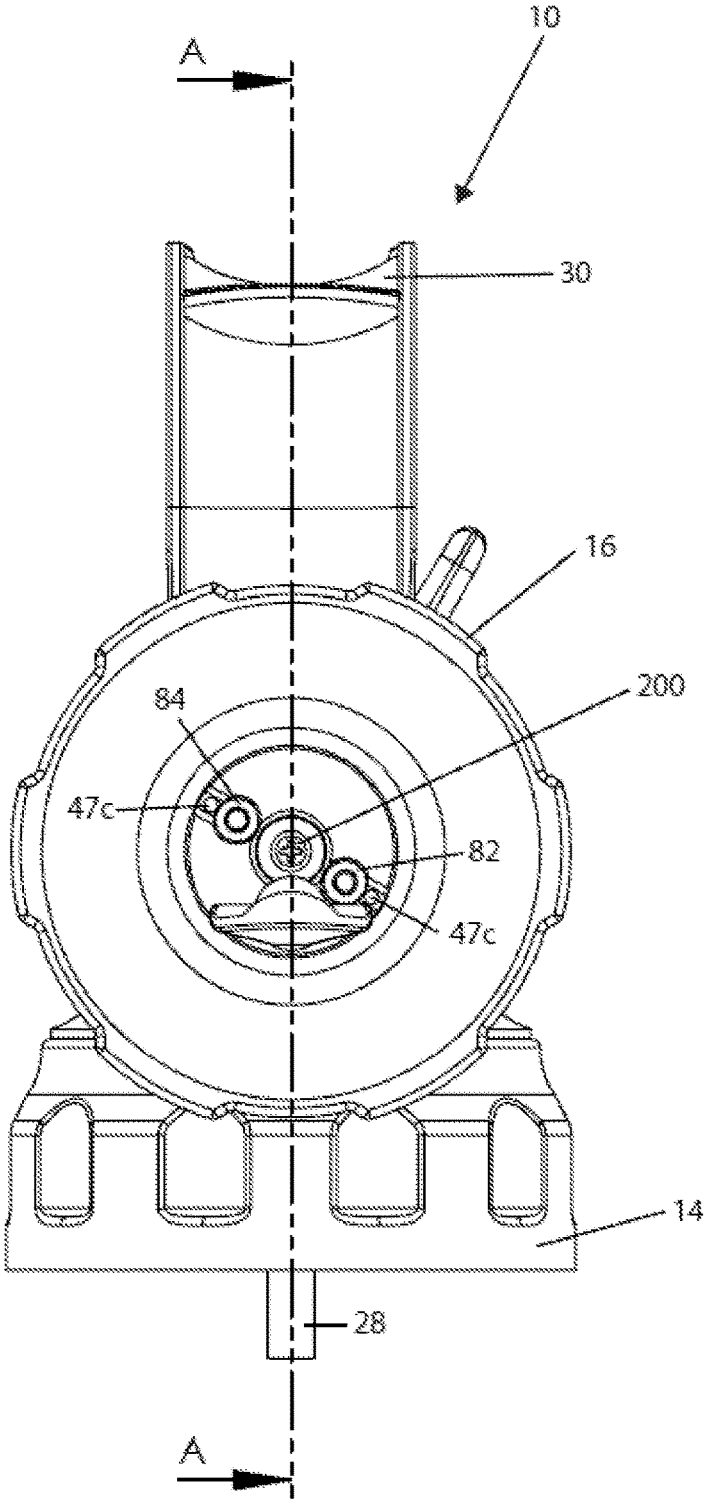
FIG. 17A is an illustration of a discharge end of a dual sprayer, in accordance with an example embodiment.

FIG. 17A is an illustration of a discharge end of a dual sprayer, in accordance with an example embodiment. This view depicts the sprayer 10 in a "rinse" mode. In this embodiment, a screw 200 may be used to hold the cylinder 40 within the socket (cavity) 42 of the housing 12 of the sprayer 10. The screw 200 may be positioned to be centrally located within the cylinder 40 in order for the screw 200 to remain stationary as the cylinder 40 may rotate to change modes.

Figure 17B:
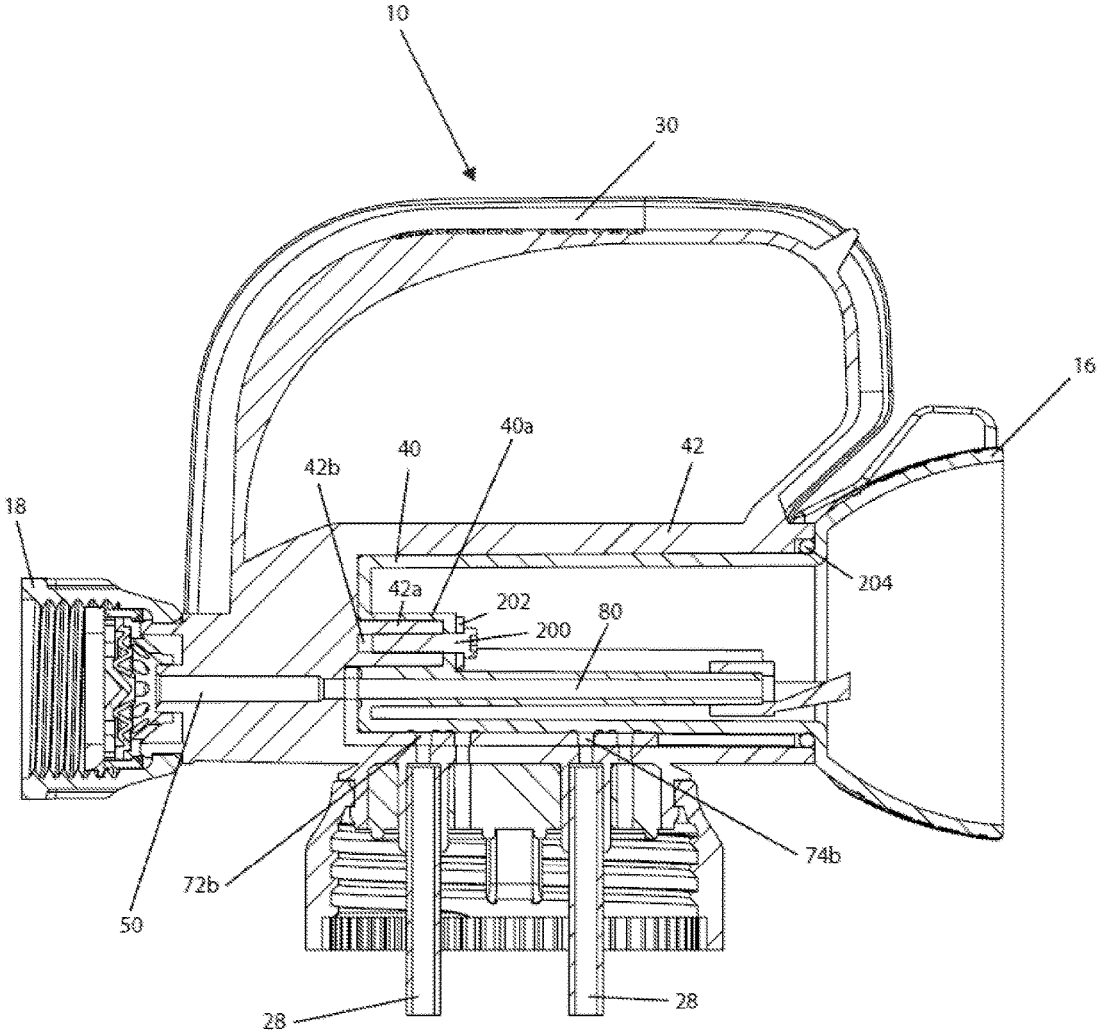
FIG. 17B is an illustration of a cross-section side-view of a dual sprayer in a rinse mode, in accordance with an example embodiment.

FIG. 17B is an illustration of a cross-section side-view of a dual sprayer in a rinse mode, in accordance with an example embodiment. In an embodiment, the socket 42 of the housing 12 may include a cylindrical extension 42*a* that may define a screw-hole 42*b*. The screw-hole 42*b* may accept the screw 200. The screw 200 may remain stationary as while the cylinder 40 is capable of rotating within the socket 42 in order to allow the sprayer 10 to switch between modes. To this end, the cylinder 40 may include a cylindrically-shaped extension 40*a* that may be conformed to the shape of the cylindrical extension 42*a* of the socket 42. A washer 202 may be positioned between a head of the screw 200 and the cylindrically-shaped extension 40*a* of the cylinder 40 in order to reduce a friction-force between the head of the screw 200 and the distal-end of the extension 40*a*. The screw 200 may represent the lone structure that may be capable and necessary to maintain the cylinder 40 within the socket 42 during assembly and during an operational use of the sprayer 10. A gasket 204 may be fitted between the end of the cylinder 40 and the socket 42 (near the outlet 16) in order to reduce potential leakage of the sprayer 10 as the sprayer 10 is in operational use.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A sprayer, comprising:

a housing defining a chamber;

a cylinder within the chamber, the cylinder defining more than one discharge tube positioned in a longitudinal direction within the housing, the cylinder being selectively rotatable within the chamber;

more than one suction tube extending from a lower portion of the housing, the more than one suction tube being in selective fluid communication with the more than one discharge tube of the cylinder as the cylinder is rotated within the chamber;

more than one suction housing within the cylinder, each of the more than one suction housing including, one of the more than one discharge tubes, and one suction channel intersecting the respective one discharge tube of the suction housing, each suction channel being in selective fluid communication with one of the more than one suction tube, the housing defining an inlet, and a central passage near the inlet of the housing, each of the more than one discharge tubes being individually and selectively aligned to be in fluid communication with the central passage as the cylinder is rotated within the chamber; and a screw penetrating a back-wall of the cylinder and a back-wall of the chamber, the screw being configured to retain the cylinder within the chamber during an operational use of the sprayer.

2. The sprayer of claim 1, wherein, the back-wall of the chamber defines a first cylindrical extension, the back-wall of the cylinder defines a second cylindrical extension, the first cylindrical extension being insertable into the second cylindrical extension, the screw penetrates the first and second cylindrical extensions, the screw being configured to remain in a stationary position as the cylinder is rotated within the chamber.

3. The sprayer of claim 1, wherein, the more than one discharge tube includes a first discharge tube, a second discharge tube, and a third discharge tube, the more than one suction housing includes, a first suction housing including the first discharge tube in fluid communication with a first suction channel, the first suction channel being in selective fluid communication with a first suction tube, of the more than one suction tube, and a second suction housing including the second discharge tube in fluid communication with a second suction channel, the second suction channel being in selective fluid communication with a second suction tube, of the more than one suction tube, the third discharge tube not including a suction housing.

4. The sprayer of claim 3, wherein each suction housing further defines at least one air return vent located adjacent to the respective suction channels of each suction housing, each of the at least one air return vents being in fluid communication with an air inlet that penetrates an end of each suction housing, each of the at least one air return vents being in selective fluid communication with a respective air port positioned adjacent to the suction tubes on the lower portion of the housing.

5. The sprayer of claim 3, wherein, the first suction channel is about perpendicular to first discharge tube, the second suction channel is about perpendicular to second discharge tube, a longitudinal length of the central passage is about parallel to the longitudinal direction of the discharge tubes within the housing.

6. The sprayer of claim 3, wherein the sprayer includes multiple operational modes depending on a rotation of the cylinder within the chamber, the multiple operational modes including, a first mode where the first discharge tube is aligned with the central passage and is in fluid communication with the first suction tube, in order to allow the sprayer to accept a pressurized working fluid to enter the inlet of the housing and pass through the first discharge tube to also draw a first liquid fluid into the first discharge tube from the first suction tube, and a second mode where the second discharge tube is aligned with the central passage and is in fluid communication with the second suction tube, in order to allow the sprayer to accept the pressurized working fluid to enter the inlet of the housing and pass through the second discharge tube to also draw a second liquid fluid into the second discharge tube from the second suction tube.

7. The sprayer of claim 6, wherein the multiple operational modes further include, a third mode where the third discharge tube is aligned with the central passage, in order to allow the sprayer to accept the pressurized working fluid to enter the inlet of the housing and pass through the third discharge tube so that the pressurized working fluid may be discharged from the sprayer without being mixed with another liquid fluid, and a fourth mode that does not allow any fluid to travel through the sprayer.

8. The sprayer of claim 7, further comprising:

a rotatable dial on an end of the cylinder and positioned to extend from the chamber of the housing, the rotatable dial being capable of manual manipulation to cause the cylinder to rotate within the chamber, indicia on an outer surface of the housing and positioned near the rotatable dial, the indicia indicating which one of the multiple operational modes the sprayer is in.

9. The sprayer of claim 1, further comprising:

a multi-chamber bottle connected to the lower portion of the housing, each of the more than one suction tubes extending into one respective chamber of the multi-chamber bottle, a number of chambers of the multi-chamber bottle equaling a number of suction housings within the cylinder of the sprayer.

10. The sprayer of claim 3, further comprising:

a dual-chamber bottle connected to the lower portion of the housing, the first suction tube extending into a first chamber of the dual-chamber bottle and the second suction tube extending into a second chamber of the dual-chamber bottle.

11. The sprayer of claim 10, further comprising:

a female connector on the lower portion of the housing, the female connector including at least one first engaging structure on an inner surface of the female connector, the first and second suction tubes emanating from the confines of the female connector to extend into the dual-chamber bottle.

12. The sprayer of claim 11, further comprising:

a male connector on a top portion of the dual-chamber bottle, the male connector including at least one second engaging structure on an outer surface of the male connector that is mateable with the at least one first engaging structure on the female connector, the dual-chamber bottle including a divider, extending from a bottom floor of the dual-chamber bottle up to the female connector of the dual-chamber bottle, that divides the dual-chamber bottle into the first chamber and the second chamber.

13. The sprayer of claim 12, wherein, the at least one first engaging structure includes at least one physical stop on the inner surface of the female connector, the at least one second engaging structure includes at least one depression positioned on the outer surface of the male connector, the at least one depression being capable of accepting and retaining the at least one physical stop of the first engaging structure.

14. The sprayer of claim 12, wherein, the at least one first engaging structure includes three physical stops equally spaced apart on the inner surface of the female connector, the at least one second engaging structure includes two depressions positioned on the outer surface of the male connector, each of the depressions being capable of accepting and retaining one of the physical stops on the female connector, the at least one second engaging structure further includes a rib extending along a portion of an outer circumference of the male connector.

15. The sprayer of claim 14, wherein the rib extends about 0.35 radians to 0.52 radians along the outer circumference of the male connector so that the female connector can be rotated about 30 degrees or less in order to respectively seat two of the physical stops within the two depressions, in order lock the female connector onto the male connector while a third physical stop is retained under the rib.

* * * * *